US009422665B2

(12) United States Patent
Ewald

(10) Patent No.: US 9,422,665 B2
(45) **Date of Patent: *Aug. 23, 2016**

(54) HEADBOX APPARATUS

(75) Inventor: James Leroy Ewald, Port St Lucie, FL (US)

(73) Assignee: PAPERCHINE INC., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/602,824

(22) Filed: Sep. 4, 2012

(65) Prior Publication Data

US 2014/0060765 A1 Mar. 6, 2014

(51) Int. Cl.
*D21F 1/00* (2006.01)
*D21F 1/02* (2006.01)

(52) U.S. Cl.
CPC ..... *D21F 1/00* (2013.01); *D21F 1/026* (2013.01)

(58) Field of Classification Search
USPC ..... 162/336, 339
See application file for complete search history.

(56) References Cited

U.S. PATENT DOCUMENTS 4,617,091 A 10/1986 Rodal et al.
5,110,416 A 5/1992 Linsuri et al.
5,147,509 A 9/1992 Kuragasaki et al.
5,183,537 A 2/1993 Hergert et al.
6,099,692 A 8/2000 Weisshuhn et al.
6,248,214 B1 6/2001 Stotz et al.
6,274,232 B1 8/2001 Otten et al.
6,383,614 B1 5/2002 Carson et al.
6,432,275 B1 8/2002 Huovila et al.
6,475,344 B1 11/2002 Aidun
6,902,651 B2 6/2005 Fujiki et al.
7,897,016 B2 * 3/2011 Ewald ..... 162/343
8,075,737 B2 * 12/2011 Ewald ..... 162/336
2008/0179032 A1 * 7/2008 Ewald ..... 162/343

* cited by examiner

*Primary Examiner* — Jacob Thomas Minskey
(74) *Attorney, Agent, or Firm* — David J. Archer

(57) ABSTRACT

A headbox apparatus for a papermaking machine is disclosed. The headbox apparatus defines a flow path for stock flowing between an upstream header and a downstream slice lip. Each block and an adjacent block of a plurality of blocks defines therebetween a flow tube for the flow therethrough of the stock. An upstream ramp is defined by a first surface for generating an upstream vortex adjacent to the first surface. A downstream ramp is defined by a second surface for generating a downstream vortex adjacent to the second surface. Adjacent blocks also generate downstream vortices which rotate in opposite directions relative to each other within the flow tube so that impact of the upstream and downstream vortices on a flow consistency and a velocity uniformity of the stock is reduced.

1 Claim, 6 Drawing Sheets

HEADBOX APPARATUS

BACKGROUND OF THE INVENTION

1. Field of the Invention

The present invention relates to a headbox apparatus for a papermaking machine.

More specifically, the present invention relates to a headbox apparatus for a papermaking machine which defines a flow path for stock flowing between an upstream header and a downstream slice lip.

2. Background Information

A conventional headbox distributor uses a tube array to spread the pulp slurry as uniformly as possible across the width of a paper machine headbox prior to the start of the drainage or other thickening process. The tube array is made up of individual round inlet tubes mounted is some manner to cause acceleration of the flow into each tube from a cross machine header or other form of supply of the slurry prior to the tube array. The pressure drop from the acceleration of the flow at the inlet of each tube within the array is critical to the uniformity of the flow within each tube, and therefore to the uniformity of the cross machine uniformity of the headbox in general. This acceleration of the flow is also a factor in the operational cleanliness of the headbox operation. The exit end of a typical tube array may take on many shapes such as round, hexagonal, rectangular, square, or other shape but eventually the flows exiting each individual tube must be re-joined prior to or within the nozzle of the headbox prior to discharge to the drainage area. The reorientation of the round tube entrance flow to the eventual rectangular shape of the nozzle will create disturbances in the flow in all directions. These disturbances must be damped or reduced in some way prior to discharge out of the slice so as to avoid nonuniformities in the paper web.

The purpose of the present invention is to create the necessary pressure drop and subsequent uniform cross machine flow distribution while minimizing the wall effects of the individual flow elements prior to the rejoining of the flows in the nozzle. Additionally, an added feature of accelerating the flow into the headbox nozzle is incorporated into the flow element design to further stabilize the flow exiting the headbox.

The entrance of each flow element is a slot shape and the discharge end of each tube is an open channel of square, rectangular, round or some other geometric shape. These flow elements can also have one or multiple changes in area between the initial flow element slot size and the discharge area of the flow element. Additionally, an added feature of accelerating the flow into the headbox nozzle is incorporated into the flow element design to further stabilize the flow exiting the headbox. The flow elements may or may not be used in conjunction with trailing members. Furthermore, the flow elements may or may not be designed to incorporate or work in conjunction with the use of a consistency profiling system.

The flow elements according to the present invention are nested together to form a close packed array on the discharge end, with little or no vertical wall continuous in any area across the width of the headbox.

To make the edge effect minimal to the pondsides, a special flow element can be supplied on each end which reduces flow instability due to side wall friction. This flow element may be larger in the entrance area than the rest of the flow elements.

Such larger inlet may additionally have an adjustable insert for flow and fiber orientation control.

The present invention uses a distributor consisting of simple slotted flow elements, expanding to another slotted expansion area (one or multiple), then to a larger discharge area. The arrangement according to the present invention will reduce cross machine non uniformity of both consistency and velocity of the stock flow. Additionally, an added feature of accelerating the flow into the headbox nozzle is incorporated into the flow element design to further stabilize the flow exiting the headbox.

The apparatus according to the present invention uses slots to minimize the vertical non uniformity of the open area at the discharge of the flow element and increases mixing of the flows in the cross machine direction at the discharge of the flow elements.

The present invention is applicable to the production of all grades of paper, and is usable with or without the inclusion of flow turbulence control sheets.

The elements according to the present invention can be fabricated out of many different types of materials including synthetic, ceramic, stainless steel, cast material, etc.

Such elements can also be used with or without a dilution control system or with or without the use of trailing members.

Therefore, it is a primary feature of the present invention to provide a headbox apparatus that overcomes the problems associated with the prior art arrangements.

Another feature of the present invention is the provision of a headbox apparatus that greatly reduces the impact of said upstream and downstream vortices on a flow consistency and a velocity uniformity of the stock.

Other features and advantages of the present invention will be readily apparent to those skilled in the art by a consideration of the detailed description of a preferred embodiment of the present invention contained herein.

SUMMARY OF THE INVENTION

The present invention relates to a headbox apparatus for a papermaking machine. The headbox apparatus defines a flow path for stock flowing between an upstream header and a downstream slice lip. The apparatus includes a plurality of blocks which are anchored within the flow path between the header and the slice lip. Each block and an adjacent block of the plurality of blocks defines therebetween a flow tube for the flow therethrough of the stock. The flow tube has an upstream portion and a downstream portion that gradually widens in at least one step in a direction from the header to the slice lip. Each block has an upstream and a downstream end with each block defining an elongate divider extending between the upstream and the downstream ends. The arrangement is such that the divider defines a first and a second side. The block defines a first surface which is disposed adjacent to the first side of the divider and a second surface which is disposed adjacent to the second side of the divider. An upstream ramp is defined by the first surface for generating an upstream vortex adjacent to the first surface. A downstream ramp is defined by the second surface for generating a downstream vortex adjacent to the second surface. Each block defines a further elongate divider extending between the upstream and the downstream ends such that the further divider defines a further first and a further second side. The block defines a further first surface which is disposed adjacent to the further first side of the further divider. A further second surface is disposed adjacent to the further second side of the further divider. A further upstream ramp is defined by the further second surface for generating a further upstream vortex adjacent to the further second surface. Also, a further downstream ramp is defined by the further first surface for generating a further downstream vortex adjacent to the further first surface such that each of the blocks and the adjacent block of the plurality of blocks generate the upstream vortices which rotate in opposite directions relative to each other within the flow tube. Adjacent blocks also generate the downstream vortices which rotate in opposite directions relative to each other within the flow tube so that impact of the upstream and downstream vortices on a flow consistency and a velocity uniformity of the stock is reduced.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
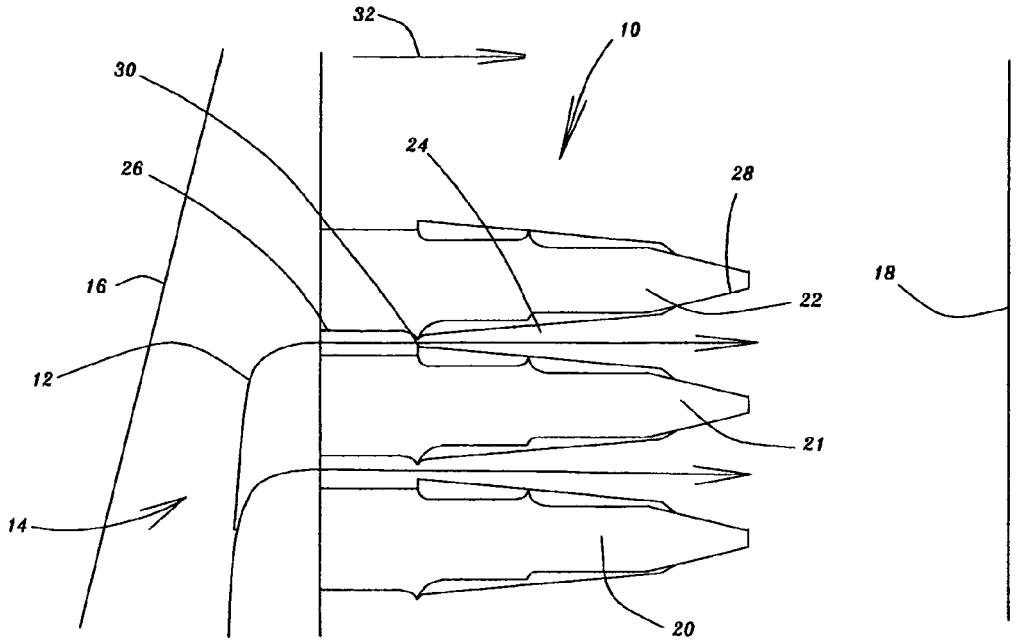
FIG. 1 is a schematic top plan view of a headbox apparatus according to the present invention.

FIG. 1 is a schematic top plan view of a headbox apparatus generally designated 10 according to the present invention. As shown in FIG. 1, the headbox apparatus 10 defines a flow path 12 for stock generally designated 14 flowing between an upstream header 16 and a downstream slice lip 18. The apparatus 10 includes a plurality of blocks 20, 21 and 22 which are anchored within the flow path 12 between the header 16 and the slice lip 18. Each block such as block 21 and an adjacent block 22 of the plurality of blocks 20-22 define therebetween a flow tube 24 for the flow therethrough of the stock 14. The flow tube 24 has an upstream portion 26 and a downstream portion 28 that gradually widens in at least one step 30 in a direction as indicated by the arrow 32 from the header 16 to the slice lip 18.

Figure 2:
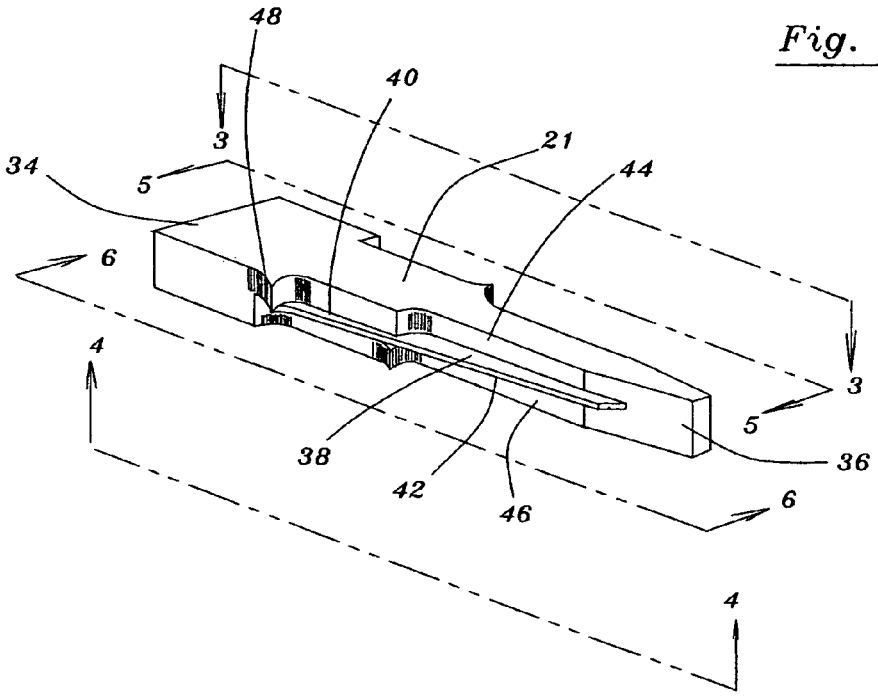
FIG. 2 is a perspective view of the block shown in FIG. 1.

FIG. 2 is a perspective view of the block 21. As shown in FIG. 2, the block 21 has an upstream end 34 and a downstream end 36 with each block 21 defining an elongate divider 38 extending between the upstream end 34 and the downstream end 36. The arrangement is such that the divider 38 defines a first side 40 and a second side 42. The block 21 defines a first surface 44 which is disposed adjacent to the first side 40 of the divider 38 and a second surface 46 which is disposed adjacent to the second side 42 of the divider 38. An upstream ramp 48 is defined by the first surface 44.

Figure 3:
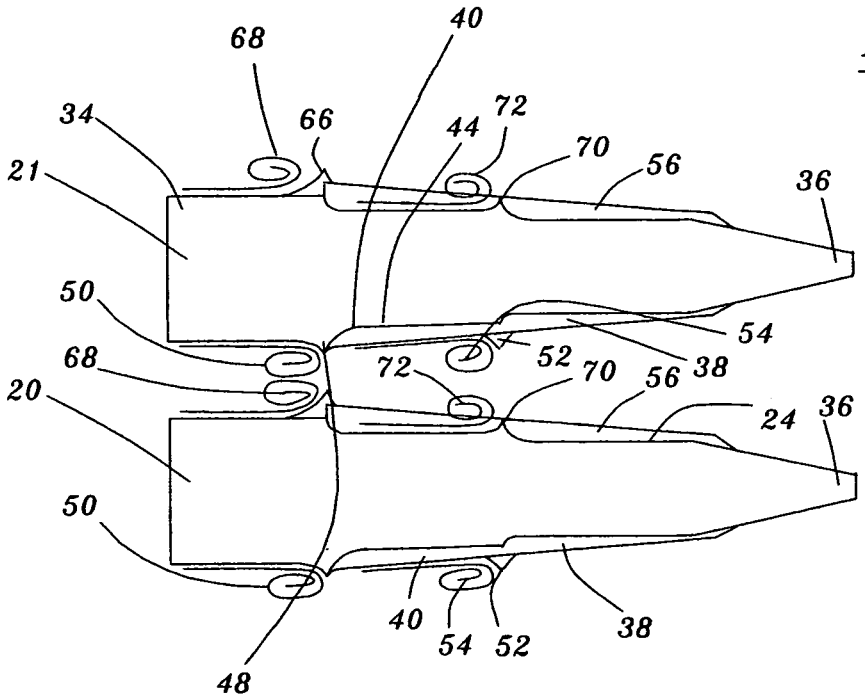
FIG. 3 is a view taken on the line 3-3 of FIG. 2.

FIG. 3 is a view taken on the line 3-3 of FIG. 2. As shown in FIG. 3, the ramp 48 is for generating an upstream vortex 50 adjacent to the first surface 44.

Figure 4:
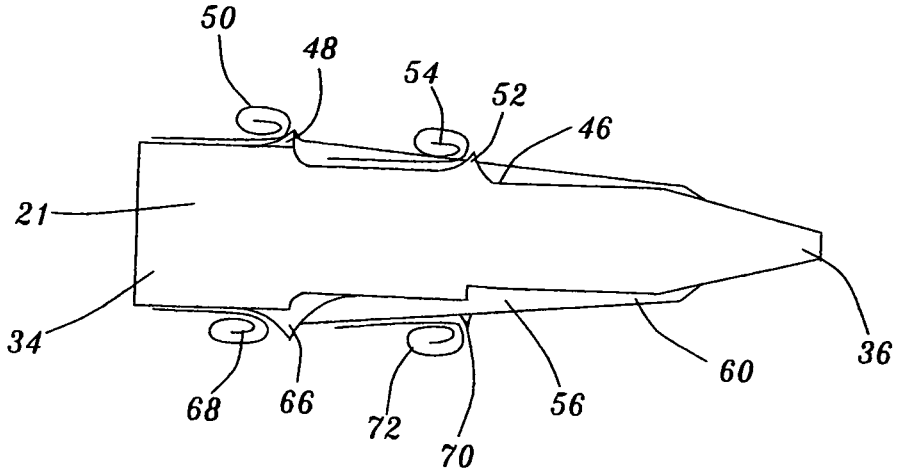
FIG. 4 is a view taken on the line 4-4 of FIG. 2; end 34 and the downstream end 36.

FIG. 4 is a view taken on the line 4-4 of FIG. 2. As shown in FIG. 4, a downstream ramp 52 is defined by the second surface 46 for generating a downstream vortex 54 adjacent to the second surface 46. Each block 21 defines a further elongate divider 56 extending between the upstream end 34 and the downstream end 36.

Figure 5:
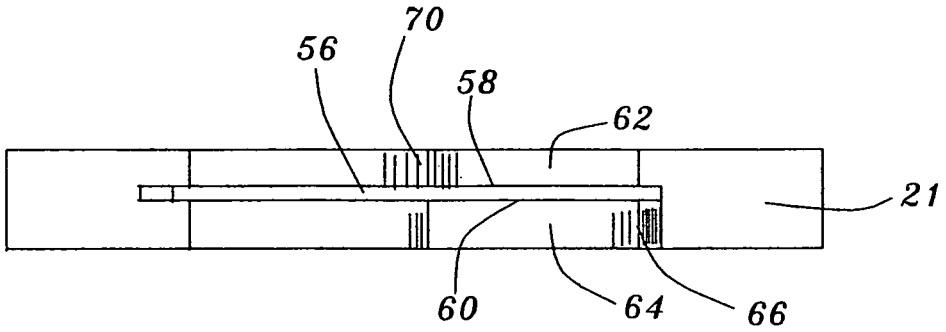
FIG. 5 is a view taken on the line 5-5 of FIG. 2.

FIG. 5 is a view taken on the line 5-5 of FIG. 2. As shown in FIG. 5, the further divider 56 defines a further first side 58 and a further second side 60. The block 21 defines a further first surface 62 which is disposed adjacent to the further first side 58 of the further divider 56. A further second surface 64 is disposed adjacent to the further second side 60 of the further divider 56. A further upstream ramp 66 is defined by the further second surface 64 for generating a further upstream vortex 68 adjacent to the further second surface 64 as shown in FIG. 3. Also, a further downstream ramp 70 is defined by the further first surface 62 for generating a further downstream vortex 72 adjacent to the further first surface 62 as shown in FIG. 3.

As shown in FIG. 3, the arrangement is such that each block such as block 21 and the adjacent block 20 of the plurality of blocks 20-22 generate the upstream vortices 50 and 68 which rotate in opposite directions relative to each other within the flow tube 24. Adjacent blocks 21 and 20 also generate the downstream vortices 54 and 72 which rotate in opposite directions relative to each other within the flow tube 24, so that impact of the upstream and downstream vortices 50, 68 and 54, 72 on a flow consistency and a velocity uniformity of the stock is reduced.

Figure 6:
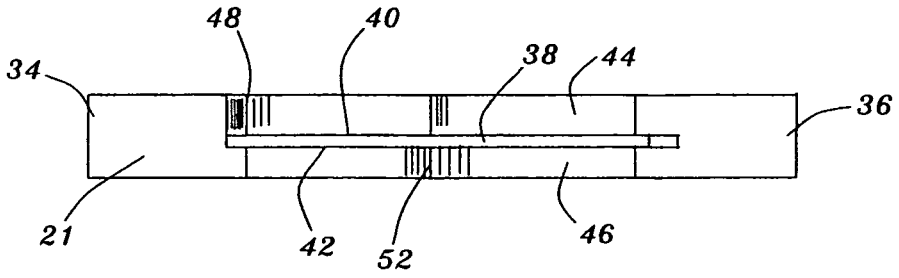
FIG. 6 is a view taken on the line 6-6 of FIG. 2.

FIG. 6 is a view taken on the line 6-6 of FIG. 2. As shown in FIG. 6, the divider 38 includes a first side 40 and a second side 42.

In operation of the headbox apparatus 10, pressurized stock 14 flows through the header 16 into each of the flow tubes 24 defined between adjacent blocks. As the stock 14 flows past the upstream ramp 48, the vortex 50 is generated. Such stock then flows out towards the slice lip 18. Also, stock flows towards the downstream ramp 52 for generating a vortex 54. On the opposite side of the flow tube 24, the block 20 has an upstream ramp 66 which generates a vortex 68 while a downstream ramp 70 generates a vortex 72. These vortices 50, 54, 68 and 72 thoroughly and evenly distribute fibers within the stock so that the stock ejected from the slice lip has a uniform consistency and velocity.

What is claimed is:

1. A headbox apparatus for a papermaking machine, said headbox apparatus defining a flow path for stock flowing between an upstream header and a downstream slice lip, said apparatus comprising:

a plurality of blocks which are anchored within the flow path between the header and the slice lip;

each block and an adjacent block of said plurality of blocks defining therebetween a flow tube for the flow therethrough of the stock;

said flow tube having an upstream portion and a downstream portion that gradually widens in at least one step in a direction from the header to the slice lip;

each block having an upstream and a downstream end, each block defining an elongate divider extending between said upstream and said downstream ends, such that said divider defines a first and a second side, said block defining a first surface disposed adjacent to said first side of said divider and a second surface disposed adjacent to said second side of said divider;

an upstream ramp defined by said first surface for generating an upstream vortex adjacent to said first surface;

a downstream ramp defined by said second surface for generating a downstream vortex adjacent to said second surface;

each block defining a further elongate divider extending between said upstream and said downstream ends, such that said further divider defines a further first and a further second side, said block defining a further first surface disposed adjacent to said further first side of said further divider and a further second surface disposed adjacent to said further second side of said further divider;

a further upstream ramp defined by said further second surface for generating a further upstream vortex adjacent to said further second surface; and a further downstream ramp defined by said further first surface for generating a further downstream vortex adjacent to said further first surface such that each of said blocks and said adjacent block of said plurality of blocks generate said upstream vortices which rotate in opposite directions relative to each other within said flow tube and generate said downstream vortices which rotate in opposite directions relative to each other within said flow tube so that impact of said upstream and downstream vortices on a flow consistency and a velocity uniformity of said stock is reduced.

* * * * *